US011987405B2

(12) United States Patent
Vaccari

(10) Patent No.: US 11,987,405 B2
(45) Date of Patent: May 21, 2024

(54) METHOD AND APPARATUS FOR WRAPPING A LOAD AND WRAPPING MACHINE

(71) Applicant: AETNA GROUP S.P.A., Verucchio (IT)

(72) Inventor: Massimiliano Vaccari, Verucchio (IT)

(73) Assignee: AETNA GROUP S.P.A., Verucchio (IT)

( * ) Notice: Subject to any disclaimer, the term of this patent is extended or adjusted under 35 U.S.C. 154(b) by 419 days.

(21) Appl. No.: 17/298,239

(22) PCT Filed: Dec. 3, 2019

(86) PCT No.: PCT/IB2019/060380
§ 371 (c)(1),
(2) Date: May 28, 2021

(87) PCT Pub. No.: WO2020/115643
PCT Pub. Date: Jun. 11, 2020

(65) Prior Publication Data

US 2022/0119139 A1 Apr. 21, 2022

(30) Foreign Application Priority Data

Dec. 4, 2018 (IT) ..... 102018000010782
Jun. 6, 2019 (IT) ..... 102019000008298

(51) Int. Cl.
*B65B 11/58* (2006.01)
*B65B 11/02* (2006.01)
*B65B 11/00* (2006.01)

(52) U.S. Cl.
CPC ..... *B65B 11/025* (2013.01); *B65B 11/58* (2013.01); *B65B 2011/002* (2013.01)

(58) Field of Classification Search
USPC ..... 53/399
See application file for complete search history.

(56) References Cited

U.S. PATENT DOCUMENTS 4,691,497 A 9/1987 Lancaster
10,703,518 B2 7/2020 Ceré
(Continued)

FOREIGN PATENT DOCUMENTS

CN 101888951 11/2010
CN 107848641 3/2018
(Continued)

OTHER PUBLICATIONS

International Search Report dated Mar. 13, 2020 in International (PCT) Application No. PCT/IB2019/060380.
(Continued)

*Primary Examiner* — Chinyere J Rushing-Tucker
(74) *Attorney, Agent, or Firm* — Wenderoth, Lind & Ponack, L.L.P.

(57) ABSTRACT

A method for wrapping a load with a film of stretchable plastic material, comprises unwinding a first film of stretchable plastic material from a first reel and at least one second film of stretchable plastic material from a respective second reel; superimposing the at least one second film to the first film so as to form a longitudinal overlapping band of the two films; stretching by a couple of pre-stretching rollers the first film and the at least one second film superimposed along the longitudinal overlapping band with a definite stretching percentage so as to obtain a single composite film formed by the first film and the at least one second film joined and sticking tightly to each other at the overlapping band due to the effect of said stretching; wrapping the load with a plurality of bands of the composite film.

20 Claims, 7 Drawing Sheets

(56) References Cited

U.S. PATENT DOCUMENTS

| | | | | |
|---|---|---|---|---|
| 2004/0055252 | A1 | 3/2004 | Suolahti | |
| 2010/0263331 | A1 | 10/2010 | Paavola et al. | |
| 2011/0121119 | A1* | 5/2011 | Galea | B29C 55/06 242/160.4 |
| 2014/0033657 | A1* | 2/2014 | Cere' | B65B 11/00 53/461 |
| 2014/0123605 | A1 | 5/2014 | Cere'et al. | |
| 2014/0331609 | A1* | 11/2014 | Bison | B65B 11/585 53/219 |
| 2018/0111709 | A1 | 4/2018 | Cere'et al. | |
| 2020/0377250 | A1* | 12/2020 | Lancaster, III | B65B 11/006 |

FOREIGN PATENT DOCUMENTS

| | | | | |
|---|---|---|---|---|
| EP | 0 938 428 | | 9/1999 | |
| EP | 1 963 188 | | 9/2008 | |
| EP | 2 448 822 | | 5/2012 | |
| GB | 1 328 255 | | 8/1973 | |
| WO | WO-2011001388 | A1 * | 1/2011 | B65B 11/025 |

OTHER PUBLICATIONS

Office Action dated Jun. 23, 2022 in corresponding Chinese Patent Application No. 201980079540.4, with English-language translation.

* cited by examiner

Fig. 11
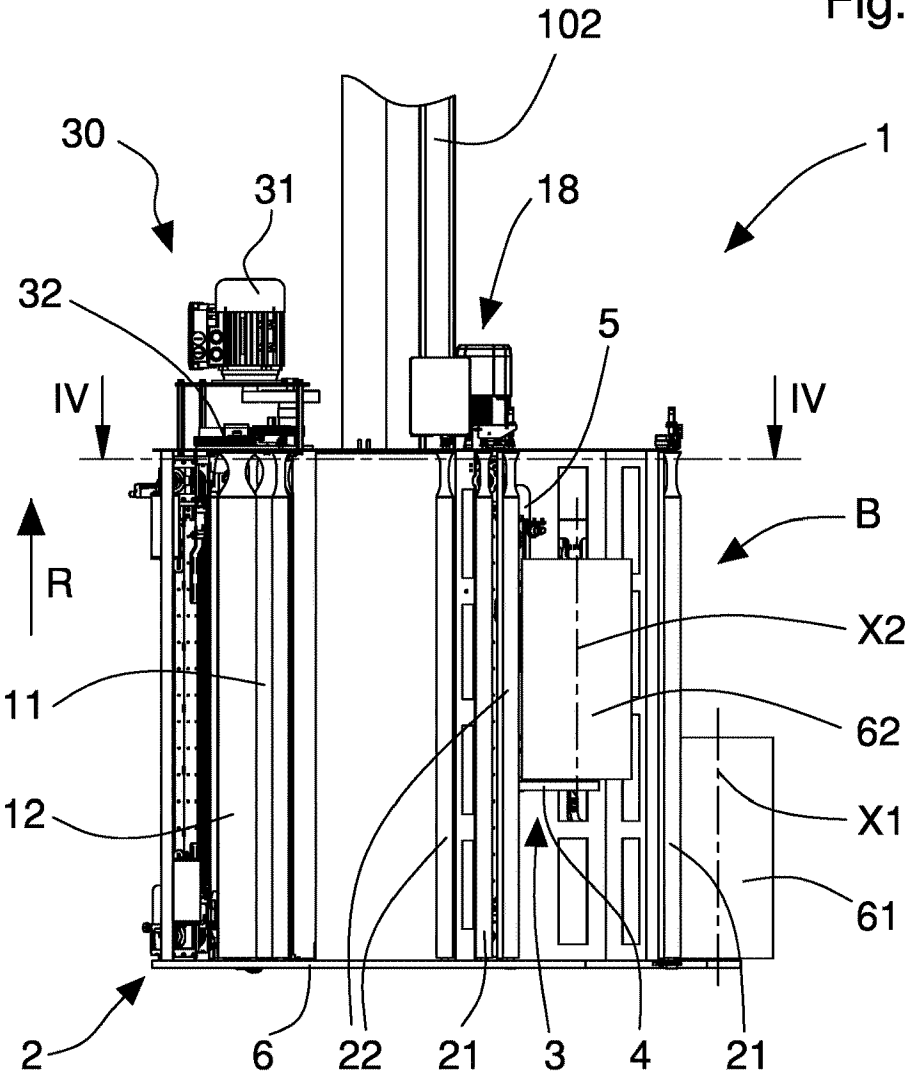
Fig. 6
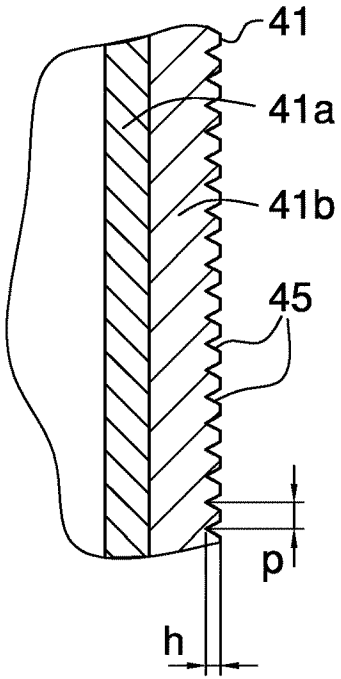
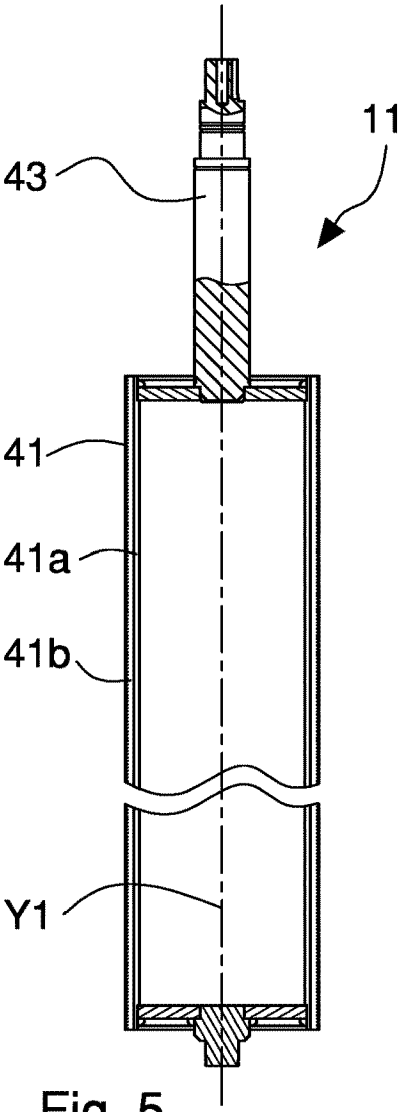
Fig. 5

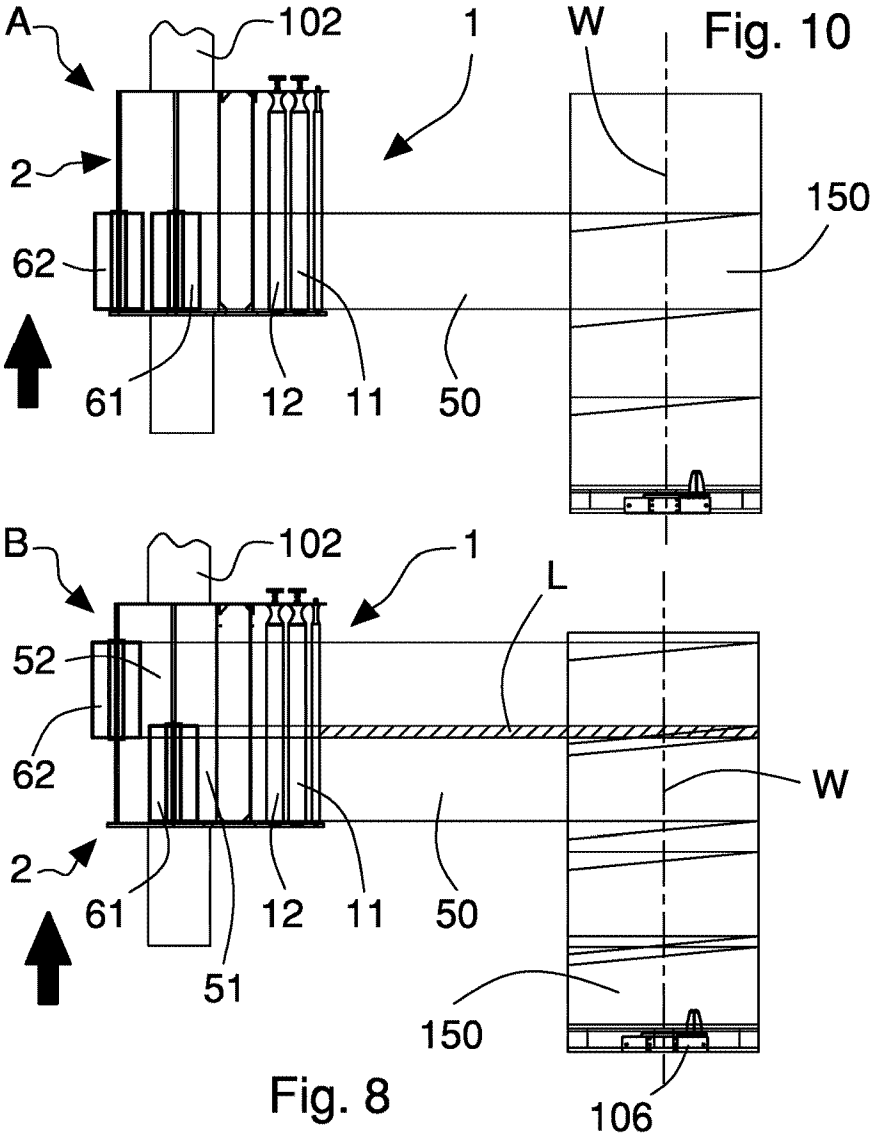
Fig. 10
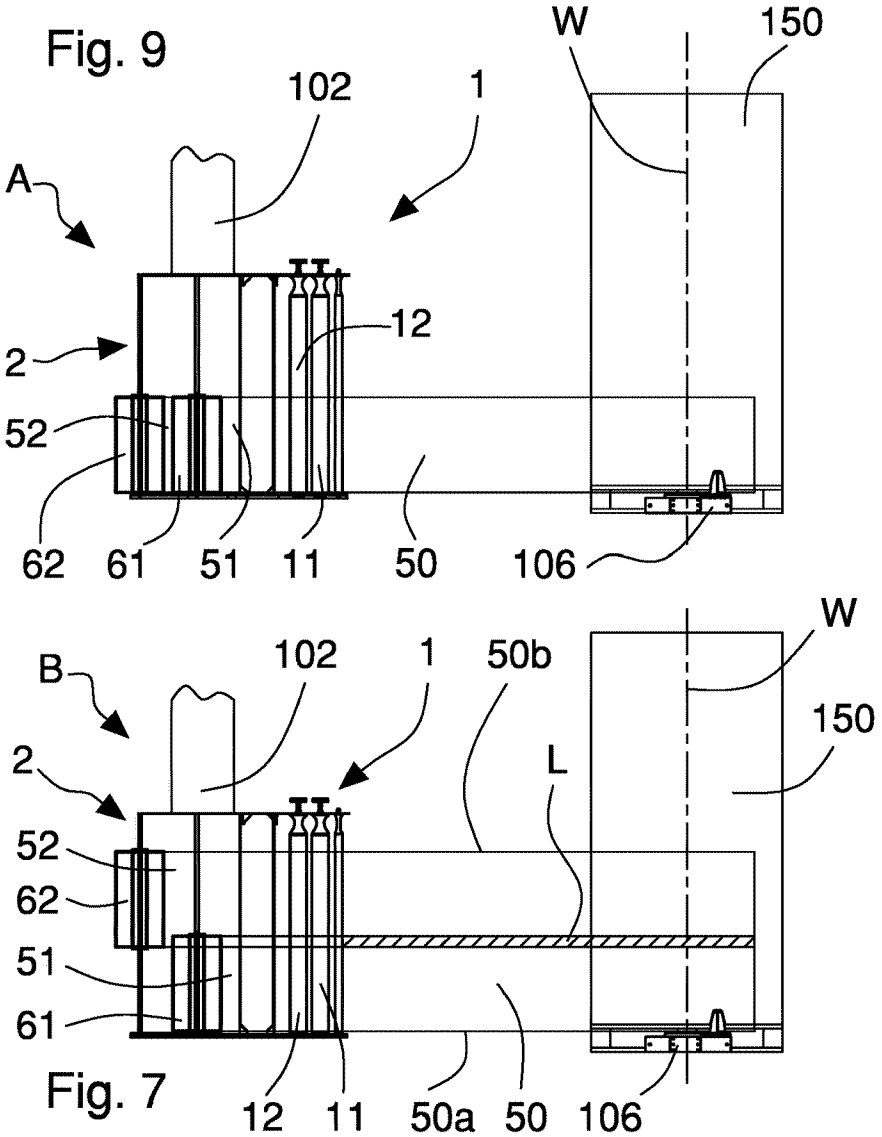
Fig. 8
Fig. 9
Fig. 7

METHOD AND APPARATUS FOR WRAPPING A LOAD AND WRAPPING MACHINE

The invention relates to machines, apparatuses and methods for wrapping a load with a film or wrap of cold-stretchable plastic material.

Wrapping with a film or wrap of cold-stretchable plastic material a load made of a single product or a plurality of products grouped on a pallet or stillage is known in the packaging industry.

The known wrapping machines comprise an unwinding apparatus which is movable parallel to and/or about a wrapping axis and supports a film reel from which the film is unwound to be wrapped around the load so as to form a series of strips or bands generally having a helical pattern, due to the combination of the relative displacements, linear and rotational, between the unwinding apparatus and the load.

In the wrapping machines provided with a rotary table for supporting the load, the latter in the wrapping process is rotated about a vertical wrapping axis, while the unwinding apparatus is moved parallel to the wrapping axis with alternating motion along a fixed column of the wrapping machine.

In horizontal rotating ring or rotating arm wrapping machines, the load remains still during the wrapping, while the unwinding apparatus is moved with respect to the latter both rotatably about a vertical wrapping axis and translationally parallel to the latter. For this purpose, the unwinding apparatus is fixed to a ring structure or to an arm rotatably supported by a frame of the machine and so as to rotate around the load.

In particular, in horizontal ring wrapping machines the unwinding apparatus is fixed to the ring structure, or rotating ring, which is rotatably supported by a moving frame or carriage so as to rotate about a vertical wrapping axis. The moving carriage is in turn slidably attached to a fixed frame of the wrapping machine so as to translate parallel to the vertical wrapping axis. In rotating arm wrapping machines the unwinding apparatus is slidably attached to the arm in such a way as to be moved linearly along the latter, parallel to the wrapping axis. In this way, in both types of machines, the film unwinding apparatus is movable parallel to and about the wrapping axis while the load to be wrapped remains fixed.

The unwinding apparatus is generally provided with a couple of pre-stretching rollers, comprising a low-speed roller and a high-speed roller, respectively upstream and downstream with respect to the movement of the film, to stretch and unwind the film, and one or more guiding rollers to redirect the film towards the load during the unwinding. By appropriately adjusting the difference between the rotation speeds of the two pre-stretching rollers, it is possible to stretch or extend by a definite amount, according to a set percentage of pre-stretching or extension, the film exiting the unwinding apparatus before it is wrapped on the load. By adjusting the rotation speed of the pre-stretching rollers, it is also possible to vary the unwinding speed of the film from the reel, i.e. the speed with which the film exits the unwinding apparatus.

For this purpose, the unwinding apparatus comprises an electric motor capable of driving in rotation one of the two pre-stretching rollers acting as a motor roller (typically the high-speed roller) and driving, via a mechanical transmission assembly, the other pre-stretching roller serving as a driven roller (typically the low-speed roller). In this way, between the high-speed roller and the low-speed roller a fixed transmission ratio is imposed, depending on the pre-stretching or extension desired to be obtained on the film.

The unwinding apparatuses may also be equipped with a couple of electric motors arranged to separately and independently drive the two pre-stretching rollers, so as to vary the pre-stretching or extension percentage of the film even during the wrapping of the load. Rotating ring wrapping machines are known, provided with a couple of unwinding apparatuses attached to the ring structure opposite to each other to wrap the load more quickly and/or more firmly. In fact, at each revolution the load can be wrapped by the two films unwound and pre-stretched by the respective unwinding apparatuses, the aforementioned films superimposing, partially or completely, on the load according to the translation speed of the ring structure along the vertical axis. In this way, it is possible to reduce the duration of the load wrapping cycle and/or to increase the number of film strips or bands wrapped in the time unit to have a more firm and solid wrapping of the load.

Similarly, wrapping machines are known being provided with a couple of rotating arms opposite to each other, each of the arms being provided with a respective unwinding apparatus. These machines allow greater wrapping flexibility by virtue of the possibility of separately and independently moving the two unwinding apparatuses vertically along the respective arms.

The aforementioned known ring or arm wrapping machines are however quite complex and expensive since they require two separate unwinding apparatuses provided with respective pre-stretching and return rollers and respective motors for driving the pre-stretching rollers. The plastic film is stretched or extended elastically and/or plastically by the pre-stretching rollers before being wrapped on the load since the stretching, or extension, allows the film to be used at best and to give the latter physical-mechanical characteristics such as to make it more suitable to withstand the forces acting on the load during subsequent manipulations and transport. In particular, when the stretching force ceases, the elastic return of the film determines a securing force on the load guaranteeing the containment of the latter.

The stretching is generally expressed as a percentage equal to the ratio between the film extension (the difference between the final length of the stretched film and the original length) and the original length. Typically, the extension imparted to the film is comprised between 50 and 400%.

As it is known, the stretching or pre-stretching force of the rollers allows to considerably reduce the film thickness (typically from about 25-20 μm to about 6-7 μm) so as to proportionally increase the length to wrap a greater perimeter of load for the same initial amount of unwound film.

The pre-stretching force exerted by the pre-stretching rollers also allows to change the mechanical characteristics of the film. The appropriately stretched material of the film can pass from a behaviour of the elastic type, wherein the film tends to recover its original dimension as the stress ceases, to a behaviour substantially of the plastic type, wherein the film undergoes a permanent deformation and does not completely recover the initial dimension as the stress ceases. In the latter case, the film of plastic material considerably reduces its elastic return ability and behaves as a flexible and substantially inextensible element, like a rope or a belt, and can be used, for example, to wrap groups of unstable products that should be kept firmly constrained to each other.

The pre-stretching force to which the film is subjected in order to obtain a certain stretching ratio or percentage depends on a plurality of factors: initial thickness of the film, physical-mechanical characteristics of the plastic material of the film (type of material, composition, amount and distribution of any internal impurities and inhomogeneities), environmental conditions (temperature, humidity) wherein the load is wrapped.

Although it is known that films of the same material and of the same nominal thickness belonging to different reels should be subjected to different pre-stretching forces to obtain similar stretching ratios and, above all, to avoid an excessive thinning which would make the film unsuitable for a correct wrapping of the load and/or more prone to lacerations and breakages, nevertheless these latter ones occur frequently during the wrapping cycles.

In fact, variations of the physical-mechanical characteristics of the film and, above all, of its thickness can be frequently encountered even in the same film reel during its unwinding. For example, depending on the production processes of the plastic film, generally linear low-density polyethylene, it is in fact possible to have films with different homogeneity and uniformity of thickness. The latter starting from a nominal value comprised between 20-25 μm can vary by ±10-20%.

Also the environmental conditions, particularly the temperature, significantly influence the performances of the stretched film. More in detail, at lower temperatures the film stretches and deforms with greater difficulty and, with the same pre-stretching ratio, it can tear and break more easily and more frequently. The film temperature is further dependent on the functioning operational conditions, particularly it increases with the increasing wrapping speed of the film and with the stretching ratio.

There is therefore a plurality of environmental and operational factors that cause, during the functioning of the wrapping machines, especially in case of high stretching ratios, excessive thinning, lacerations and even breakages in the film. Such drawbacks result in incorrectly wrapped loads or stopping of the production and the wrapping machine to replace the film reel.

Lacerations and breakages of the film also occur in case of wrapping irregular loads, provided with corners, protruding and sharp portions and the like. Lacerations and tears in the film can also propagate on the latter and lead to the complete breakage of the film both during the wrapping (typically in the case of high stretching ratios) and after the wrapping, following the moving and transport of the load.

An object of the invention is to improve the known methods for wrapping a load with films of stretchable plastic material and the known unwinding apparatuses which may be associated with wrapping machines to wrap a load with films of stretchable plastic material. Another object is to provide a method and an unwinding apparatus associable with a wrapping machine that allow to wrap any type of load in a firm and compact manner, reducing and virtually eliminating the risks of complete breakage of the film during the wrapping with consequent stopping of the production.

A further object is to provide a method, an unwinding apparatus and a relative wrapping machine allowing high versatility and flexibility of the wrapping process.

Yet another object is to make a method and an unwinding apparatus and a relative wrapping machine allowing to significantly reduce the wrapping times of a load and/or to make load wrappings that are firmer and more compact.

Yet a further object is to make a simple and economical wrapping machine, having a reliable and precise functioning.

In a first aspect of the invention there is provided a method for wrapping a load according to claim 1.

In a second aspect of the invention there is provided an unwinding apparatus associable with a wrapping machine according to claim 6.

In a third aspect of the invention there is provided a wrapping machine according to claim 15. The invention can be better understood and implemented with reference to the attached drawings which illustrate exemplifying and non-limiting embodiments thereof, wherein:

FIG. 5 is a section of a first pre-stretching roller of the unwinding apparatus of FIG. 2;

FIG. 6 is an enlarged detail of the section of FIG. 5;

FIGS. 7 and 8 are schematic views illustrating a wrapping method made by the unwinding apparatus and the wrapping machine of FIG. 1 with the second film reel of the unwinding apparatus arranged in an operative position, in respective steps of a load wrapping cycle;

FIGS. 9 and 10 are schematic views illustrating the wrapping method made by the unwinding apparatus and the wrapping machine of FIG. 1 with the second film reel of the unwinding apparatus arranged in a further operative position, in respective steps of a load wrapping cycle;

FIG. 11 is a side view of a variant of the unwinding apparatus of the invention;

Figure 1:
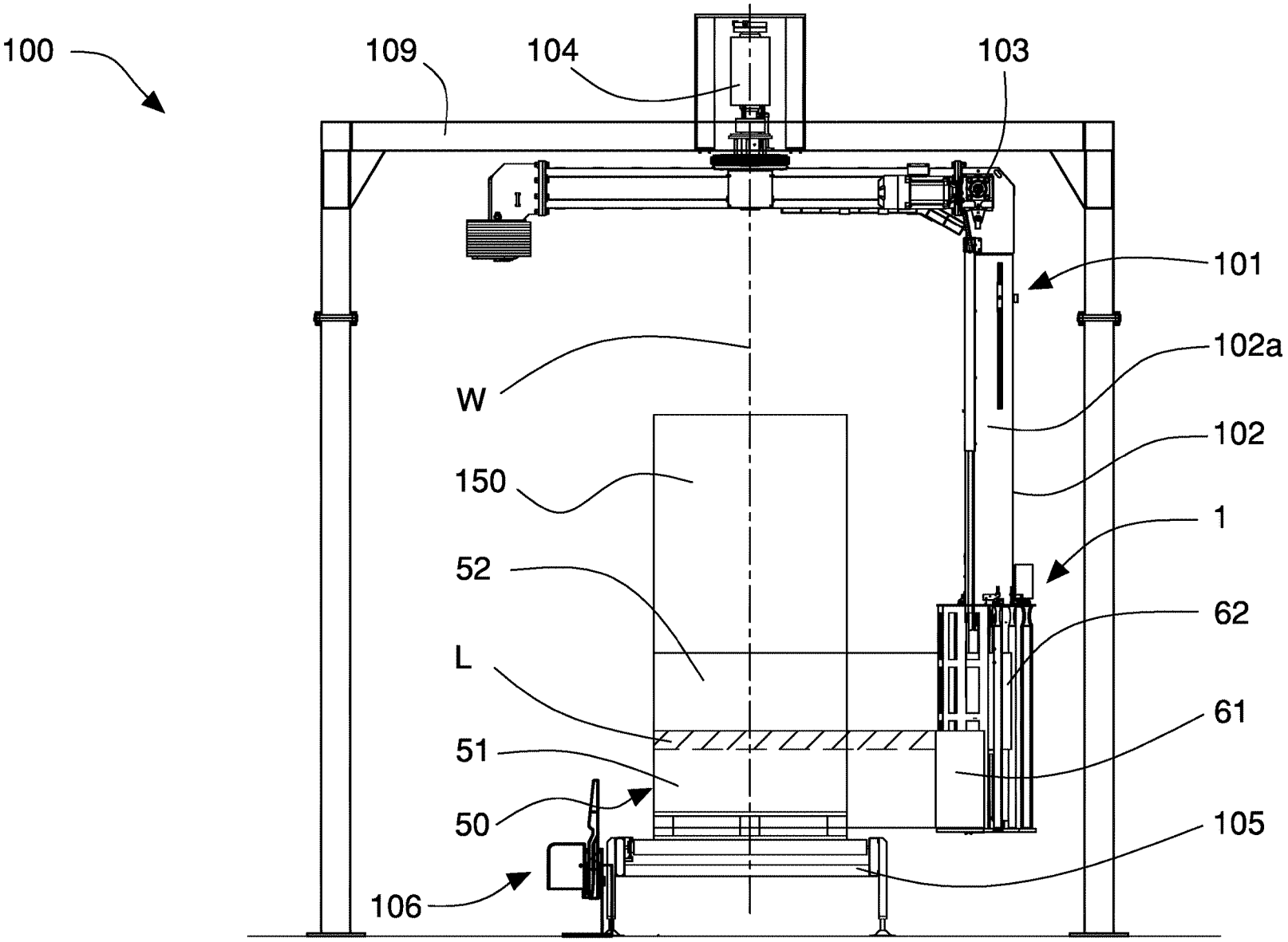
FIG. 1 is a front view of the film unwinding apparatus of the invention associated with a wrapping machine of the rotating arm type.
Figure 3:
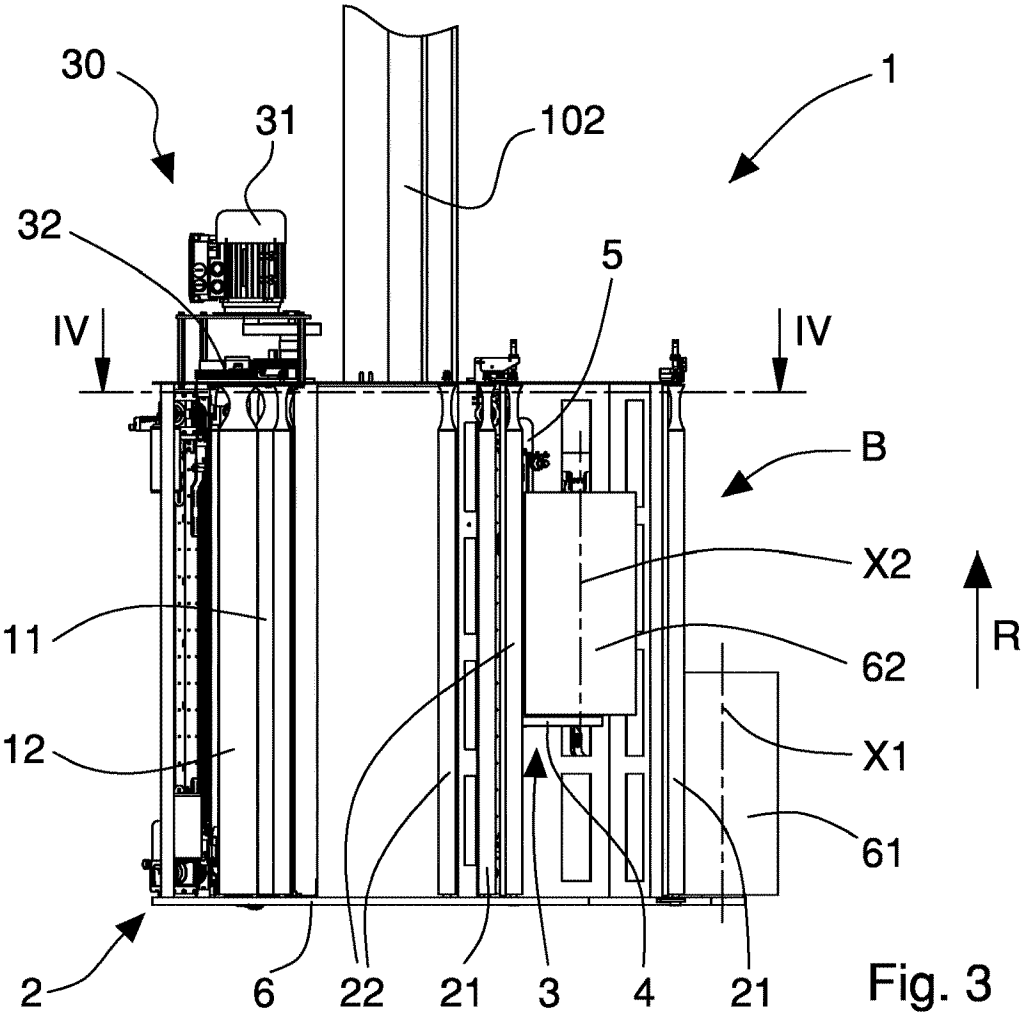
FIG. 3 is a side view of the unwinding apparatus of FIG. 2.
Figure 2:
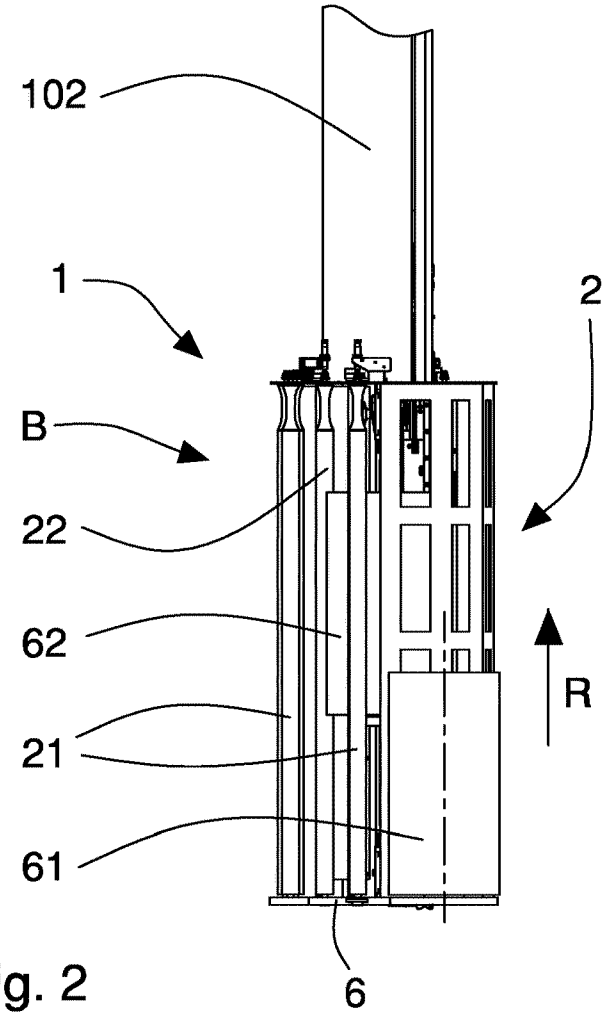
FIG. 2 is an enlarged partial view of the unwinding apparatus of the invention with a second film reel arranged in an operative position.
Figure 4:
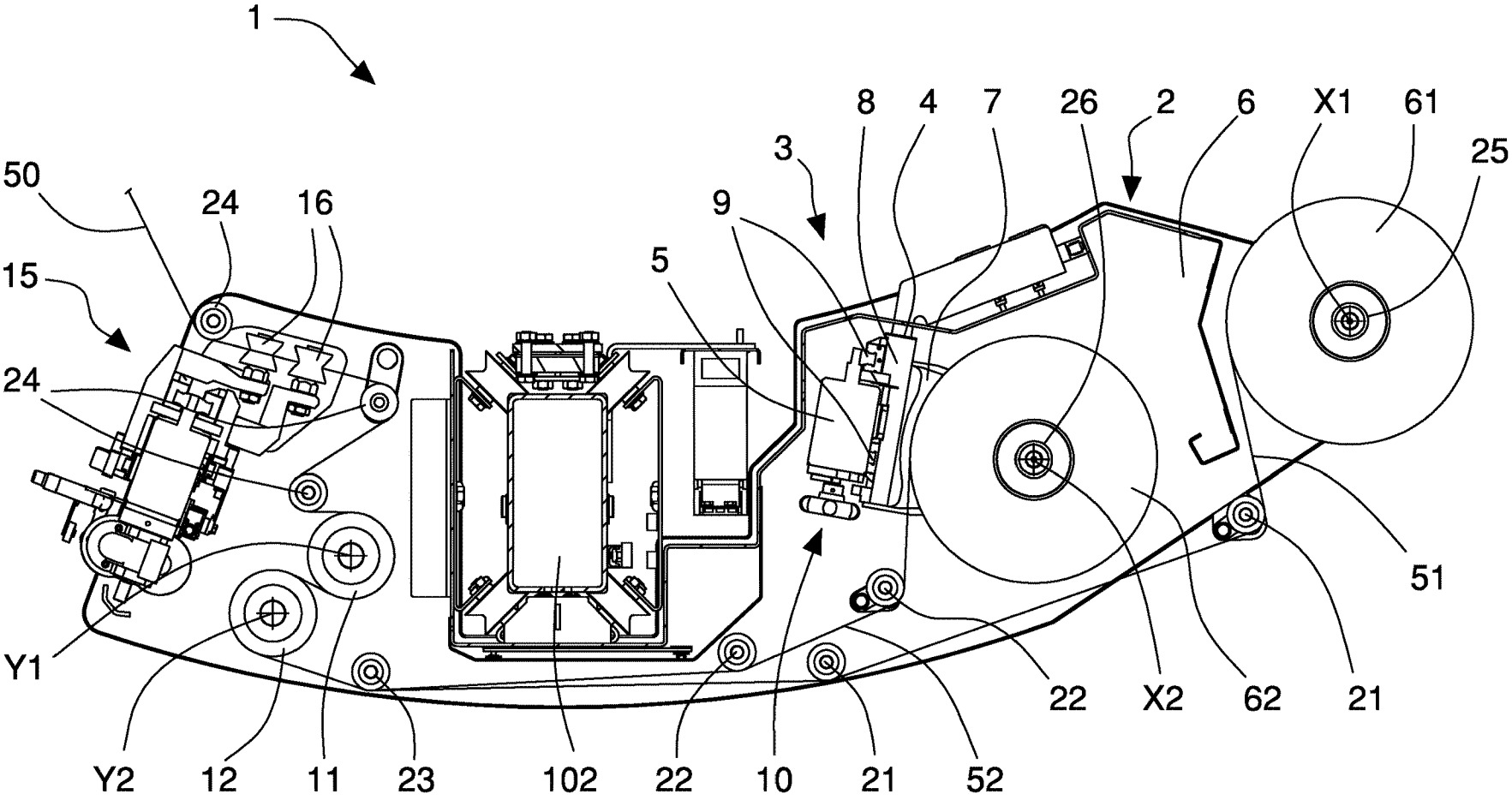
FIG. 4 is an enlarged cross section along the line Iv-Iv of FIG. 3.

Referring to FIGS. 1 to 6, the unwinding apparatus 1 of the invention is illustrated associated with a wrapping machine 100 for wrapping with films of cold-stretchable plastic material a load 150, for example formed by one or more products grouped on a pallet.

The wrapping machine 100 is, for example, of the rotating arm type and provided with a moving system 101 to move parallel to a wrapping axis W the unwinding apparatus 1 which is arranged to dispense a first film 51 and at least one second film 52 both of stretchable plastic material.

The unwinding apparatus 1 comprises a supporting frame 2 connected to the moving system 101 of the wrapping machine 100 and arranged to support rotatably about a first axis X1 a first reel 61 of a first film 51 and a first pre-stretching roller 11 and at least one second pre-stretching roller 12.

The unwinding apparatus 1 further includes adjustment assembly 3 adapted to support at least one second reel 62 of a second film 52 rotatably about a respective second axis X2 and allow to move said second reel 62 with respect to the first reel 61 along an adjustment direction R parallel to the first axis X1 and second axis X2 in one of a plurality of operative positions B, wherein the second reel 62 is offset with respect to the first reel 61 with reference to a supporting plane 6 of the supporting frame 2.

The second reel 62 can also be moved to a further operative position A, wherein it is substantially aligned with the first reel 61 with reference to the supporting plane 6, i.e. it is placed at the same distance from the latter.

Preferably, the first reel 61 and the second reel 62 have the same height or length (cross dimension parallel to a rotation axis of the reel itself) i.e. the same band width of the respective films 51, 52.

The unwinding apparatus 1 further comprises guiding rollers 21, 22, 23 rotatably attached to the supporting frame 2 and arranged to superimpose and guide the first film 51 and second film 52 towards the pre-stretching rollers 11, 12. The latter ones are configured to unwind and stretch the first film 51 and second film 52 after the aforementioned films 51, 52 have been superimposed by the guiding rollers 21, 22, 23 at a longitudinal overlapping band L during the load wrapping process 150, so as to obtain a single composite film 50 formed by the first film 51 and second film 52 joined and sticking tightly to each other at the aforementioned overlapping band L due to the effect of an elastic/plastic stretching given by the pre-stretching rollers 11, 12, as better explained in the following description. The overlapping band L is longitudinal, i.e. parallel to an unwinding direction of the films 51, 52 from the rollers 21, 22, 23, and parallel to longitudinal edges 50*a*, 50*b* of the composite film 50.

The adjustment assembly 3 comprises a carriage 4 adapted to rotatably support the second reel 62 and a supporting column 5 fixed to the supporting frame 2 and arranged to slidably support the carriage 4 along the adjustment direction R so as to vary a position of the second reel 62 with respect to the first reel 61. More precisely, by moving the carriage 4 along the supporting column 5 it is possible to position the second reel 62 in one of the plurality of operative positions B, wherein the second reel 62 is offset with respect to the first reel 61 with reference to the supporting plane 6 so that during the functioning the second film 52 is unwound and superimposed on the first film 51 exiting the unwinding apparatus 1.

It should be noted that each of the plurality of operative positions B involves a respective width or height of the overlapping band L between the two films 51, 52, which can be selected based on the type of load and/or wrapping to be performed.

In the further operative position A, wherein the second reel 62 is substantially aligned with the first reel 61, the second film 52 is unwound and completely superimposed on the first film 51 and therefore the width of the overlapping band L is equal to the height or width of films 51, 52.

The first rotation axis X1 and the second rotation axis X2 of the two reels 61, 62 are almost orthogonal to the supporting plane 6 to which also the pre-stretching rollers 11, 12, the guiding rollers 21, 22, 23 and a first winder 25, supporting the first reel 61, are rotatably attached. To the supporting plane 6 is further attached the supporting column 5.

In the illustrated embodiment, the carriage 4 can be manually moved along the supporting column 5, in particular to regulate its distance from the supporting plane 6 of the supporting frame 2, and the unwinding apparatus 1 comprises locking element 10 to lock the aforementioned carriage 4 to the supporting column 5 in a definite operative position B, so as to prevent undesired movements thereof along the adjustment direction R, in particular during the functioning of the wrapping machine, i.e. during the unwinding of the composite film 50. The locking element 10 comprise, for example, a locking screw rotatably fixed to the carriage 4 and acting on the supporting column 5. In particular, the locking screw is provided at one end with a knob by which it can be rotated by an operator to lock or unlock the carriage 4.

The carriage 4 comprises a platform 7 almost parallel to the supporting plane 6 and to which a second winder 26 supporting the second reel 62 is rotatably attached. The carriage 4 further comprises a sliding portion 8 parallel to the supporting column 5 to which it is slidably connected by linear sliding guides 9 of the known type and not described in detail.

It is further provided, in a version of the wrapping machine 100 not shown in the figures, for the adjustment assembly 3 of the unwinding apparatus 1 to be arranged to support a plurality of second reels 62 of second films 52 and, for this purpose, to comprise a plurality of carriages 4, each one arranged to rotatably support a respective second reel 61, and one or more supporting columns 5 attached to the supporting frame 2 and arranged to slidably support the plurality of carriages 4 along the adjustment direction R. In this version of the wrapping machine the pre-stretching rollers 11, 12 are arranged to extend or stretch a plurality of films 51, 52 after the latter have been superimposed at a plurality of longitudinal overlapping bands L, particularly before entering the pre-stretching rollers 11, 12 so as to obtain a single composite film 50 formed by the first film 51 and the plurality of second films 52 joined and sticking tightly to one another at the corresponding overlapping bands L. The widths of the overlapping bands L can be the same or different, depending on the type of load and/or wrapping to be performed.

With particular reference to FIGS. 5 and 6, each pre-stretching roller 11, 12 comprises a respective external wall 41, in particular cylindrical, around which the films 51, 52 are wound, which is provided with a plurality of annular grooves 45 spaced apart from one another, in particular by a pitch p comprised between 0.5 mm and 3 mm, in particular equal to 1.5 mm, and almost orthogonal to a respective longitudinal rotation axis Y1, Y2 of the pre-stretching roller 11, 12.

In the embodiment illustrated by way of non-limiting example, each annular groove 45 has a height or depth h comprised between 0.5 mm and 1.5 mm, in particular equal to 0.8 mm, and a sectional shape, i.e. on a longitudinal section plane (as shown in FIGS. 5 and 6), which is triangular with an opening angle, for example, comprised between 45° and 90°, in particular equal to 60°. Alternatively, the annular groove 45 can have a trapezoidal or semicircular shape or the like.

The external wall 41 of each pre-stretching roller 11, 12, in particular cylindrical, comprises an inner supporting portion 41*a*, in particular also cylindrical, connected to a respective central rotation shaft 43 of the pre-stretching roller 11, 12 and an external covering portion 41*b* provided with the plurality of annular grooves 45. The external covering portion 41*b* is made in particular of plastic material, in particular polyurethane.

As better explained in the following description, the pre-stretching rollers 11, 12 also by virtue of the annular grooves 45 formed on the external walls 41 on which the films 51, 52 are wound, allow not only to extend or stretch the latter by a definite stretching amount or percentage, but also to fix and adhere the films 51, 52 at the longitudinal overlapping band L so as to form the composite film 50.

The guiding rollers comprise one or more first guiding rollers 21, in particular two, to guide the first film 51 from the first reel 61 to the pre-stretching rollers 11, 12 and one or more second guiding rollers 22, for example two, to guide the second film 52 from the second reel 62 to the pre-stretching rollers 11, 12. The guiding rollers further comprise a third guiding roller 23 to overlap and guide towards the pre-stretching rollers 11, 12 the first film 51 and second film 52 unwound from the respective reels 61, 62, in particular exiting the first and second guiding rollers 21, 22.

The unwinding apparatus 1 further comprises one or more return rollers 24, for example three, rotatably attached to the supporting frame 2, in particular to the supporting plane 6, and arranged to guide the superimposed first film 51 and second film 52 exiting the pre-stretching rollers 11, 12 towards the load 150 to be wrapped.

A first driving system 30 is provided for rotating the pre-stretching rollers 11, 12 about respective longitudinal rotation axes Y1, Y2, in particular with different rotation speeds. In the embodiment illustrated in the figures, the first driving system 30 comprises an electric motor 31 for rotating the first pre-stretching roller 11 or high-speed roller, and the second pre-stretching roller 12 or low-speed roller via transmission system 32. The transmission system 32 comprise, for example, a plurality of selectable and interchangeable gear wheels so as to modify a transmission ratio between the pre-stretching rollers 11, 12 i.e. to allow the electric motor 31 to rotate the second pre-stretching roller 12 at a respective speed lower than the one of the first pre-stretching roller 11, in particular lower than a definite value so as to stretch or extend the films 51, 52 by a given amount or percentage.

The first pre-stretching roller 11 is placed downstream of the second pre-stretching roller 12 with reference to the unwinding direction of the films 51, 52.

Alternatively, the first driving system 30 can comprise a couple of electric motors each one acting on a respective pre-stretching roller 11, 12.

In the embodiment illustrated by way of non-limiting example, the unwinding apparatus 1 further comprises a folding arrangement 15 placed downstream of the pre-stretching rollers 11, 12, with reference to the unwinding direction of the films 51, 52, and arranged to abut and roll one or both of the longitudinal edges 50*a*, 50*b* of the composite film 50 and make respective reinforcement rolled longitudinal portions.

The folding arrangement 15, of the known type and therefore not described in detail, comprise for example a couple of folding mini rollers 16 arranged to abut the aforementioned opposed longitudinal edges 50*a*, 50*b* of the composite film 50.

In the embodiment shown in FIG. 1, the wrapping machine 100 is of the rotating arm type and the moving system 101 comprises an arm means 102 rotatable about the substantially vertical wrapping axis W, and provided with a supporting portion 102*a* almost parallel to the aforementioned wrapping axis W and adapted to slidably support the unwinding apparatus 1. The moving system 101 further includes a second driving system 103 arranged to linearly move the unwinding apparatus 1 along the supporting portion 102*a* of the arm 102, i.e. parallel to the rotation axis W.

The rotation axes X1, X2 of the two reels 61, 62 are almost parallel to the wrapping axis W. The arm 102 is rotatably supported by a main frame 109 of the wrapping machine 100 and are rotated about the wrapping axis W by a third driving system 104.

The wrapping machine 1 includes a conveyor 105 for supporting the load 150 to be wrapped and moving it entering and/or exiting a work area.

The wrapping machine 100 further comprises a gripping and cutting assembly 106 arranged adjacent the conveyor 105 in the work area to grasp the films 51, 52 at the end of the wrapping, cut them and retain the ends of the films generated by the cut so as to allow the wrapping of a subsequent load 150.

The functioning of the unwinding apparatus 1 of the invention associated with the wrapping machine 100 provides for an initial adjustment phase wherein, if necessary, the position of the second reel 62 with respect to the first reel 61 is adjusted according to the dimensions and/or composition of the load 150 and/or of the requested type of wrapping. In particular, by acting on the adjustment assembly 3, the second reel 62 can be arranged in one of a plurality of operative positions B wherein the reels 61, 62 are offset with respect to the supporting plane 6 so that the two films 51, 52 may exit the unwinding apparatus 1 partially superimposed along the longitudinal overlapping band L whose height is a function of the position of the second reel 62 (FIGS. 7 and 8).

The second reel 62 may also be arranged in the further operative position A, wherein the two reels 61, 62 are aligned with respect to the supporting plane 6 so that the two films 51, 52 exit the unwinding apparatus 1 completely superimposed (FIGS. 9 and 10) i.e. with the overlapping band L having the same width as the single films 51, 52.

Once the load 150 has been introduced into the work area by the conveyor 105, the wrapping cycle can be activated and the two films 51, 52 are unwound from the respective reels 61, 62, superimposed at the third guiding roller 23 along the overlapping band L, stretched by the pre-stretching rollers 11, 12 with a definite stretching percentage so as to obtain a single composite film 50 formed by the first film 51 and the second film 52 joined and sticking tightly to each other at the longitudinal overlapping band L. The composite film 50 exiting the unwinding apparatus 1 is wrapped around the load 150 to form a series of strips or bands having a helical pattern, due to the combination of the linear and rotational movements of the unwinding apparatus 1 itself.

Referring to FIGS. 7 and 8, in the case wherein the load 150 is formed by a plurality of regular products grouped in a substantially stable manner on a pallet, the two reels 61, 62 can be arranged offset (with the second reel in an operative position B) so that the two films 51, 52 exit the unwinding apparatus 1 partially superimposed so as to increase the band breadth of the composite film 50 and reduce the number of revolutions of the unwinding apparatus 1 around the load necessary to wrap it completely.

Referring to FIGS. 9 and 10, in the case wherein the load 150 is formed by a plurality of irregular products grouped on a pallet to be wrapped tightly and securely to give high stability and solidity to the load once wrapped, the two reels 61, 62 can be aligned (with the second reel in the further operative position A) so that the two films 51, 52 exit the unwinding apparatus 1 completely superimposed so as to have a substantially double composite film 50 having greater tensile strength and less elasticity.

The method according to the invention for wrapping a load 150 with a film of stretchable plastic material comprises the following steps:

- unwinding a first film 51 of stretchable plastic material from a first reel 61 and at least one second film 52 of stretchable plastic material from a second reel 62;
- superimposing the at least one second film 52 to the first film 51 so as to form a longitudinal overlapping band L of the aforesaid films 51, 52;
- stretching or extending by a couple of pre-stretching rollers 11, 12 the first film 51 and the at least one second film 52 superimposed along the longitudinal overlapping band L with a definite stretching percentage so as to obtain a composite film 50 formed by the first film 51 and the at least one second film 52 joined and sticking tightly to each other at the longitudinal overlapping band L due to the effect of said stretching;
- wrapping the load 150 with a plurality of bands of the composite film 50.

According to the method of the invention there is provided to stretch or extend the films 51, 52 superimposed along the overlapping band L by a couple of pre-stretching rollers 11, 12, each one provided with a respective external wall 41, in particular cylindrical, around which the films 51, 52 are wound and provided with a plurality of annular grooves 45 spaced apart from one another, in particular by a pitch p comprised between 0.5 mm and 3 mm, in particular equal to 1.5 mm, and almost orthogonal to a respective longitudinal rotation axis Y1, Y2 of the pre-stretching roller 11, 12.

It is also optionally provided, after having stretched the films 51, 52, to roll up at least one of the longitudinal edges 50*a*, 50*b* of the composite film 50 exiting the pre-stretching rollers so as to form a reinforcement rolled longitudinal portions. Preferably, both longitudinal edges 50*a*, 50*b* of the composite film 50 are rolled.

According to the method of the invention, wrapping the films 51, 52 around the load 150 comprises moving the reels 61, 62 and the load 150 with respect to each other parallel to and about a wrapping axis W.

Due to the unwinding apparatus and the method of the invention it is possible to wrap a load 150 with an individual composite film 50 formed by a first film 51 and at least one second film 52 joined and sticking tightly to each other at a longitudinal overlapping band L, whose width or height can be selected based on the type of load and/or wrapping to be performed. For this purpose, the unwinding apparatus 1 is provided with at least two reels 61, 62 of film 51, 52 and allows to adjust the position of at least one of them (the second reel 62) so as to dispense the composite film 50.

It should be highlighted that due to stretching and extending by the pre-stretching rollers 11, 12 of the two films 51, 52 after being superimposed (at the third guiding roller 23 and before winding on the pre-stretching rollers 11, 12), the aforementioned films 51, 52 in addition to being stretched or extended, strongly adhere to each other in a sort of "cold welding" so as to form an individual composite film 50 exiting the unwinding apparatus 1.

In fact, as verified by the applicant following numerous tests and in an unexpected way, the two films 51, 52 firmly adhere to each other at the overlapping band L following an increase in the contact pressure between them due to the tensile force exerted by the pre-stretching rollers 11, 12, to the shape of their external walls 41 (provided with annular grooves 45) and to an angle with which the films 51, 52 are wound around the pre-stretching rollers 11, 12. More precisely, referring to a winding path of the films 51, 52 around the pre-stretching rollers 11, 12, the process of coupling and adhesion between the two films 51, 52 (at the overlapping band L) begins on the second, low-speed, pre-stretching roller 12 starting from an initial tangency point of the two films 51, 52, due to the tensile or extension force to which they are subjected. Then, following the profile of the second pre-stretching roller 12, the annular grooves 45 impose on the films 51, 52 to extend so as to allow the plastic material of the films 51, 52 to penetrate within the aforementioned annular grooves 45, thus causing a softening of the plastic material itself. In the segment of the wrapping path comprised between the two pre-stretching rollers 11, 12, i.e. in the segment wherein there is the greatest contact of the films 51, 52 with the second low-speed pre-stretching roll 12 and there is still no contact with the first high-speed pre-stretching roll 11, the pre-stretching or extension value is maximum and it is in such segment that the coupling and adhesion process between the two films 51, 52 is mostly made. Such process ends leading to a firm and stable adhesion when the two films 51, 52 wind on the external wall 41 of the first high-speed pre-stretching roller 11, the plastic material of the two films penetrating within the respective annular grooves 45.

In other words, due to the effect of the elastic/plastic stretching imparted by the pre-stretching rollers 11, 12 (provided with annular grooves 45 on their external walls 41) to the two films 51, 52 when already superimposed, the aforementioned films 51, 52 form an individual composite film 50 provided with an overlapping/adhesion band L which also results having a greater strength to the tensile force than the one of the single films and therefore serving as a reinforcement band. It is therefore possible to considerably increase the mechanical strength of the wrapping made on the load 150, for the same amount of film used with respect to the traditional wrappings which require the use of a single film or two films applied separately from respective unwinding apparatuses (for example in double rotating arm wrapping machines), in such machines the superimposing of the film bands occurring directly on the load during the wrapping.

The wrapping which the unwinding apparatus 1 and the method of the invention allow to make is therefore more firm and tight around the load 150, thus ensuring a greater seal against the infiltration of water and humidity and a correct securing in all the areas or portions of the load, even in those not offering a resistant support to the film.

To increase the mechanical strength of the composite film 50, the latter can be further provided with reinforcement rolled longitudinal portions made by the folding arrangement 15, abutting and rolling the opposite longitudinal edges 50*a*, 50*b* of the composite film 50.

It has also been observed that the overlapping band L also serves as a band for stopping the propagation of lacerations and/or tears which may occur due to various factors and causes during the wrapping cycle. More precisely, a laceration occurring on one of the films, for example exiting the unwinding apparatus 1, can propagate towards an external and free longitudinal edge of the film, but it stops at the overlapping band L, wherein the film in question adheres firmly and stably to the other film. In this way, complete breakages of one or both films, which may lead to stopping the wrapping cycle or to its completion using one single film cannot occur.

It should be noted that a partial laceration of one of the films (partial since stopped by the overlapping band L) does not in any way compromise the regular continuation of the wrapping cycle nor the effectiveness of the wrapping of the load 150, since the band of composite film 50 provided with this partial laceration maintains its mechanical characteristics (tensile strength) substantially unchanged.

A greater laceration and tearing strength of the composite film 50 can also be obtained in this case by providing on the latter reinforcement rolled longitudinal portions made by the folding arrangement 15, abutting and rolling the opposite longitudinal edges 50*a*, 50*b* of the composite film 50.

It must also be noted that thanks to the unwinding apparatus 1 of the invention it is possible to increase the band breadth of the composite film 50, i.e. of the two joined films which simultaneously wrap the load 150 so as to reduce the duration of the wrapping cycle and increase the productivity of the wrapping machine 100.

More precisely, by increasing the band breadth of the two superimposed films 51, 52, i.e. of the composite film 50, fewer revolutions of the unwinding apparatus 1 are required around the load 150 in order to be able to wrap it completely. In this way it is possible to reduce the duration of the wrapping cycle and increase the productivity of the wrapping machine 100. It is also possible to wrap a load 150 of limited dimensions with a series of overlapping bands of composite film 50 without helical pattern, i.e. without linearly displacing the unwinding apparatus 1 along the wrapping axis W, arranging the second reel 62 in a respective operative position B wherein the band breadth or width of the composite film 50 thereby made is equal to the height of the load 150. This wrapping, in addition to requiring a shorter execution time, is more firm and solid.

It must be finally noted that, due to the fact of sticking and forming an individual composite film 50, it is not necessary, in a final step of the wrapping cycle, that the gripping and cutting assembly 106 of the wrapping machine 100 grasp and hold both films 51, 52, yet it is sufficient that they lock only a portion of the composite film 50 since the two films 51, 52 are firmly constrained to each other at the overlapping band L. In this way, the same gripping and cutting assembly used to operate on a single film regardless of the extent of the overlap may be used.

The unwinding apparatus 1 of the invention installed on a wrapping machine 100 of the invention therefore allows to achieve high versatility and flexibility in the wrapping processes. At the same time, in addition to being particularly compact and functional, the unwinding apparatus 1 has a very reliable and precise functioning.

FIG. 11 illustrates a variant of the unwinding apparatus 1 of the invention which differs from the embodiment previously described and illustrated in FIGS. 1 to 6, in that it comprises, instead of the locking element 10, actuator device 18 suitable for moving the carriage 4 along the supporting column 5. The aforementioned actuator device 18 comprises, for example, a rotary electric motor arranged to linearly move the carriage 4 via a screw-nut assembly. Alternatively, the actuator device can comprise an electric linear motor acting directly on the carriage 4.

The actuator device 30 allows the second reel 61 to be automatically moved along the adjustment direction R, without manual intervention by the operator. In this way, the extent of the superimposing of the two films 51, 52 can also be varied during the wrapping cycle, thus making the wrapping machine 100 even more efficient, flexible and productive. In particular, it is possible to vary the breadth of the two superimposed films 51, 52 during the wrapping according to the portion of the load (upper, central, intermediate) to be wrapped so as to optimize its stability.

Referring to FIGS. 12 to 15, the unwinding apparatus 1 of the invention associated with a wrapping machine 110 of the so-called horizontal rotating ring type is illustrated. In this embodiment of the wrapping machine 110, the moving system 111 comprises a ring 112, rotatable about the substantially vertical wrapping axis W, and arranged to support the unwinding apparatus 1. The moving system 111 also includes a carriage 113 movable parallel to the wrapping axis W, slidingly supported by a main frame 119 of the wrapping machine 110 and rotatably supporting the ring 112.

To the main frame 119 are further attached gripping and cutting assembly 116 of the films 51, 52 suitable for grasping the films 51, 52 at the end of the wrapping, cutting them and retaining the ends of the films 51, 52 generated by the cut so as to allow the wrapping of a subsequent load 150.

The wrapping machine 1 includes a conveyor, of a known type and not illustrated in the figures, to support the load 150 to be wrapped and to move it entering and/or exiting a work area.

Figure 13:
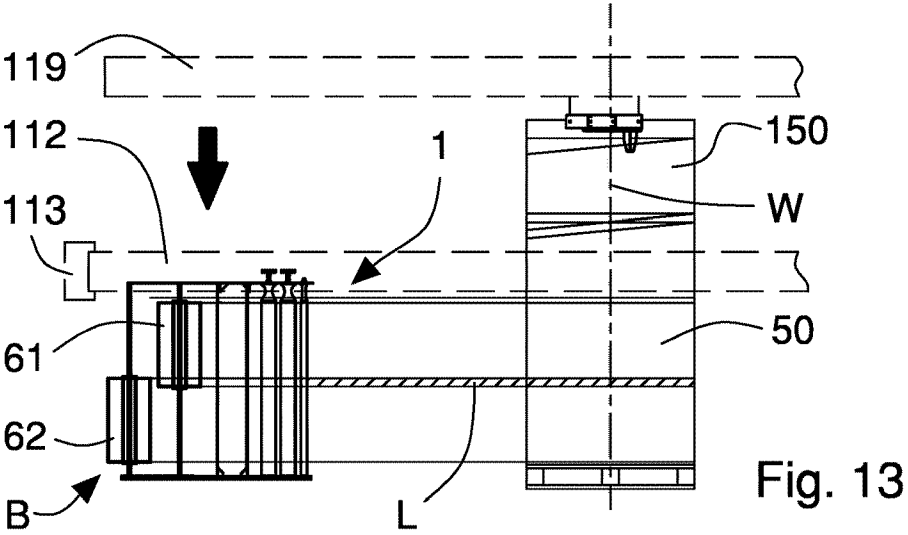
FIGS. 12 and 13 are schematic views of the film unwinding apparatus of the invention associated with a wrapping machine of the horizontal rotating ring type, with the second film reel arranged in an operative position, in respective steps of a load wrapping cycle.
Figure 12:
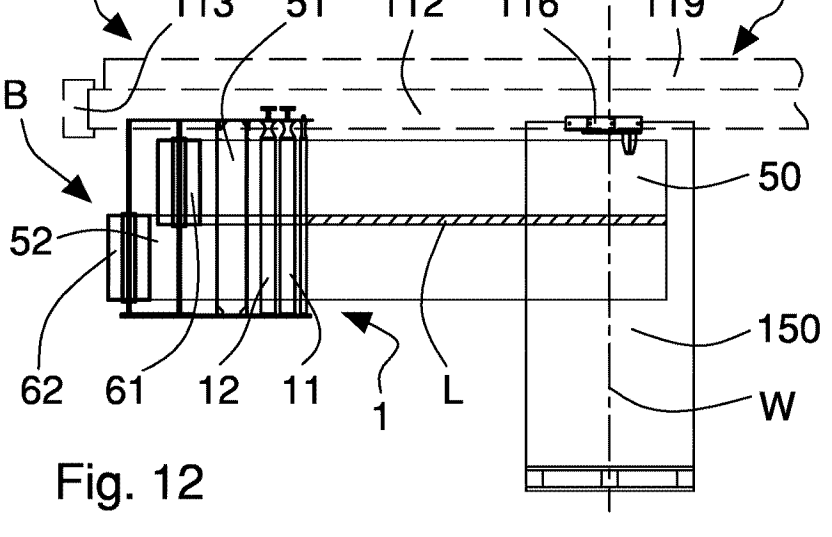

The functioning of the unwinding apparatus in this embodiment of the wrapping machine 110 is substantially similar to the one previously described for the rotating arm wrapping machine and provides for an functioning mode wherein the second reel 62 is arranged in an operative position B wherein it is offset with respect to the first reel 6 so that the two films 51, 52 exit the unwinding apparatus 1 partially superimposed along the longitudinal overlapping band L whose height is a function of the position of the second reel 62 (FIGS. 12 and 13).

Figure 15:
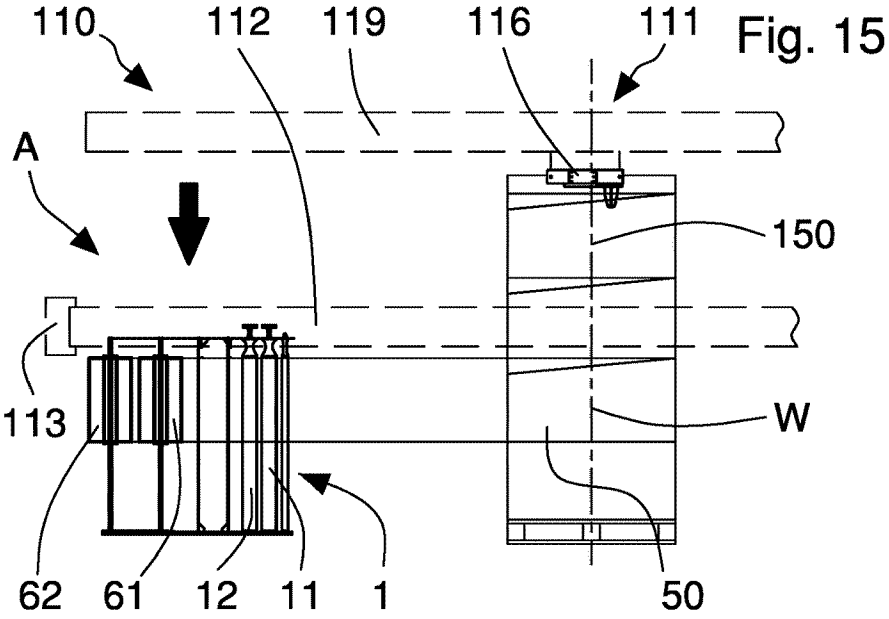
FIGS. 14 and 15 are schematic views of the unwinding apparatus and wrapping machine of FIGS. 12 and 13 with the second film reel in a further operative position, in respective steps of a load wrapping cycle.
Figure 14:
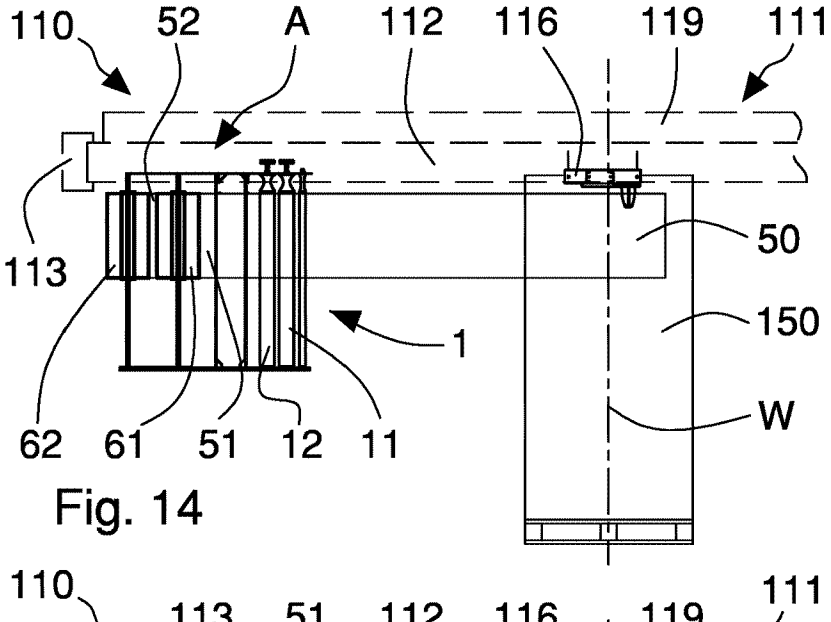

The second reel 62 can also be arranged in the further operative position A, wherein the two reels 61, 62 are aligned with respect to the supporting plane 6 so that the two films 51, 52 exit the unwinding apparatus 1 completely superimposed (FIGS. 14 and 15).

Figure 16:
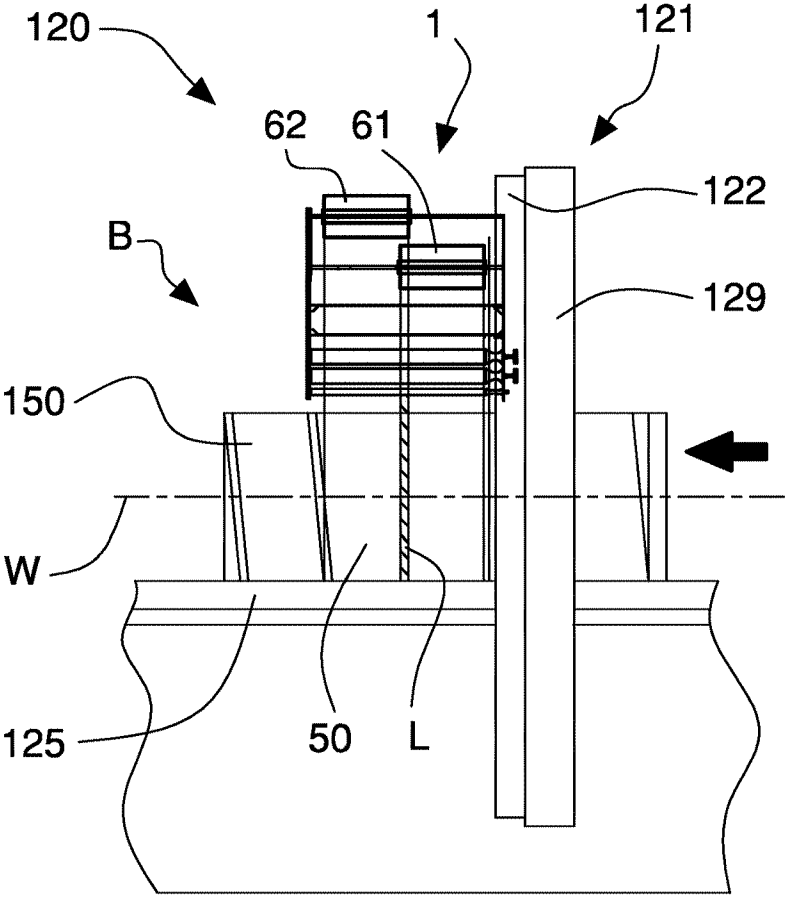
FIG. 16 is a schematic view of the film unwinding apparatus of the invention associated with a wrapping machine of the vertical rotating ring type, with the second film reel arranged in an operative position.

Referring to FIG. 16, the unwinding apparatus 1 of the invention associated with a wrapping machine 120 of the so-called vertical rotating ring type is illustrated. In this embodiment of the wrapping machine 120, the moving system 121 comprises a ring 122, rotatable about the substantially horizontal wrapping axis W, and arranged to support the unwinding apparatus 1. The wrapping machine 1 includes a conveyor 125, of the known type, arranged to support the load 150 and move it through the ring 122 so as to be wrapped by a series of bands of the films 51, 52 having a helical pattern by virtue of the combination of the linear displacement of the load 150 parallel to the wrapping axis W and of the rotation of the unwinding apparatus 1 about the latter. A main frame 129 supports the ring 122.

The functioning of the unwinding apparatus 1 associated with this embodiment of the wrapping machine 120 is substantially similar to the one previously described.

Figure 17:
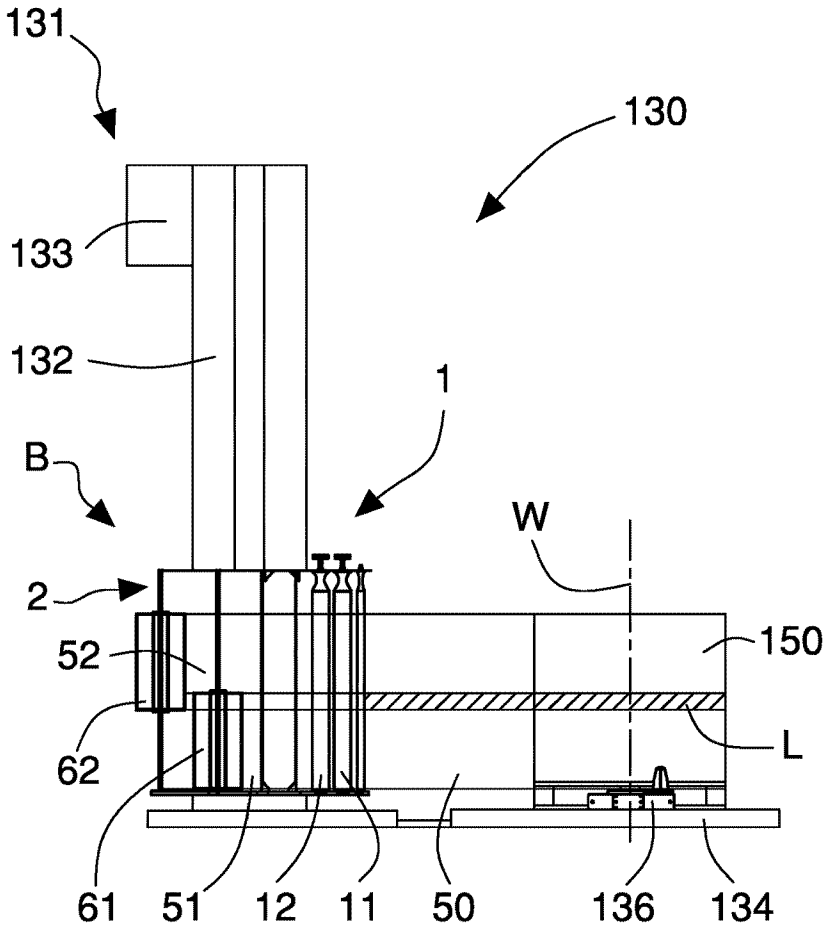
FIG. 17 is a schematic view of the film unwinding apparatus of the invention associated with a wrapping machine of the turntable type, with the second film reel arranged in an operative position.

Referring to FIG. 17, the unwinding apparatus 1 of the invention associated with a wrapping machine 130 of the so-called turntable type is illustrated. This wrapping machine 130 comprises a rotary table 134 arranged to support and rotate about the almost vertical wrapping axis W the load 150. The moving system 131 comprises a fixed column 132, which slidably supports the unwinding apparatus 1, and second driving system 133 arranged to linearly displace the unwinding apparatus 1 along the column 132, i.e. parallel to the wrapping axis W.

The wrapping machine 130 further comprises a gripping and cutting assembly 136 arranged adjacent the rotary table 134 to grasp the films 51, 52 at the end of the wrapping, cut them and retain the ends of the films generated by the cut so as to allow the wrapping of a subsequent load 150.

The functioning of the unwinding apparatus 1 associated with this embodiment of the wrapping machine 130 is substantially similar to the one previously described. In this case the load 150 is wrapped by a series of bands of films 51, 52 having a helical pattern by virtue of the combination of the linear displacement of the unwinding apparatus 1 along the column 132 and of the rotation of the load 150 about the wrapping axis W. It is also possible to wrap the load 150 with a series of superimposed bands of films 51, 52 without helical pattern, as shown in FIG. 17, i.e. without displacing the unwinding apparatus 1 along the column 132, arranging the second reel 62 in an appropriate operative position B wherein the band breadth or width of the two partially superimposed films 51, 52 is equal to the height of the load 150. Such wrapping in addition to requiring a shorter execution time, is more firm and solid.

The invention claimed is:

1. A method for wrapping a load with film of stretchable plastic material with a single unwinding apparatus of a wrapping machine, the method comprising:

unwinding a first film of stretchable plastic material from a first reel and at least one second film of stretchable plastic material from a respective second reel;

superimposing the at least one second film to the first film so as to form a longitudinal overlapping band where the at least one second film and the first film contact each other;

stretching by a plurality of pre-stretching rollers the superimposed first film and at least one second film having the longitudinal overlapping band with a definite stretching percentage so as to obtain a single composite film formed by the superimposed first film and at least one second film joined and sticking tightly to each other at the longitudinal overlapping band due to said stretching; and wrapping the load with a plurality of bands of the composite film.

2. The method according to claim 1, wherein each of the pre-stretching rollers comprises a respective external wall around which the first film and the at least one second film are wound and which is provided with a plurality of annular grooves spaced apart from one another and almost orthogonal to a respective longitudinal rotation axis of the pre-stretching roller.

3. The method according to claim 1, further comprising, after said stretching, rolling up at least one longitudinal edge of the composite film so as to form a reinforcement rolled longitudinal portion.

4. The method according to claim 1, wherein said unwinding comprises unwinding the first film of stretchable plastic material from the first reel and a plurality of second films of stretchable plastic material from respective second reels, said superimposing comprises superimposing the first film and the plurality of second films so that two adjacent films are superimposed along a respective longitudinal overlapping band where the two adjacent films contact each other, and said stretching comprises stretching by the plurality of pre-stretching rollers the superimposed first film and plurality of second films having the respective longitudinal overlapping bands with a definite stretching percentage so as to obtain a single composite film formed by the superimposed first film and plurality of second films joined and sticking tightly to each other at the respective longitudinal overlapping bands due to said stretching.

5. The method according to claim 1, wherein said wrapping comprises moving the first and second reels and the load one with respect to the other, parallel to and about a wrapping axis.

6. An unwinding apparatus associable with a wrapping machine and arranged to dispense a plurality of films, the unwinding apparatus comprising:

a supporting frame arranged to support rotatably about a first axis a first reel of a first film of stretchable plastic material;

a first pre-stretching roller and a second pre-stretching roller rotatably supported by said supporting frame;

an adjustment assembly to support rotatably about a second axis at least one second reel of at least one second film and move the at least one second reel with respect to the first reel along an adjustment direction parallel to the first axis and the second axis at least in one of a plurality of operative positions, the at least one second reel being offset with respect to the first reel with reference to a supporting plane of said supporting frame; and guiding rollers rotatably supported by said supporting frame and arranged to superimpose and guide the first film and the at least one second film towards said first and second pre-stretching rollers, wherein said first and second pre-stretching rollers are configured to unwind and stretch the first film and the at least one second film superimposed by said guiding rollers at a longitudinal overlapping band so as to obtain a composite film formed by the first film and the at least one second film joined and sticking tightly to each other at the longitudinal overlapping band due to an elastic/plastic stretching imparted by said first and second pre-stretching rollers.

7. An unwinding apparatus according to claim 6, wherein each of said first and second pre-stretching rollers comprises a respective external wall around which the first film and the at least one second film are wound, said external wall being provided with a plurality of annular grooves spaced apart from one another and almost orthogonal to a respective longitudinal rotation axis of said pre-stretching roller.

8. The unwinding apparatus according to claim 7, wherein each of said annular grooves has a height between 0.5 mm and 1.5 mm.

9. The unwinding apparatus according to claim 7, wherein each of said external walls of said first and second pre-stretching rollers comprises an inner supporting portion and an external covering portion provided with said plurality of annular grooves.

10. The unwinding apparatus according to claim 9, wherein, for each of said first and second pre-stretching rollers, said inner supporting portion of said external wall is connected to a respective central rotation shaft of said pre-stretching roller, and said external covering portion provided with said plurality of annular grooves is made of plastic material.

11. The unwinding apparatus according to claim 7, wherein the annular grooves are spaced apart from one another by a pitch of between 0.5 mm and 3 mm.

12. The unwinding apparatus according to claim 6, wherein said adjustment assembly comprises at least one carriage for rotatably supporting the at least one second reel and at least one supporting column fixed to said supporting frame and arranged to slidably support said at least one carriage along the adjustment direction between the plurality of operative positions, wherein the second film is unwound and partially superimposed to the first film.

13. The unwinding apparatus according to claim 12, further comprising a locking element for locking said carriage to said supporting column so as to prevent movements thereof along the adjustment direction at least direction, in particular during unwinding of the composite film.

14. The unwinding apparatus according to claim 12, further comprising an actuator device for moving said carriage along said supporting column.

15. The unwinding apparatus according to claim 6, wherein said adjustment assembly is arranged to support a plurality of second reels of second films, said adjustment assembly comprising a plurality of carriages, each of which is arranged to rotatably support a respective one of the second reels, and at least one supporting column fixed to said supporting frame and arranged to slidingly support said plurality of carriages along the adjustment direction.

16. The unwinding apparatus according to claim 6, wherein said guiding rollers comprise at least one first guiding roller for guiding the first film from the first reel to said first and second pre-stretching rollers, at least one second guiding roller for guiding the second film from the at least one second reel to said first and second pre-stretching rollers, and at least one third guiding roller for guiding and superimposing the first film and the second film.

17. A wrapping machine for wrapping a load with plastics film, the wrapping machine comprising a moving system for moving about and/or parallel to a wrapping axis, and the unwinding apparatus according to claim 6.

18. The wrapping machine according to claim 17, wherein said moving system comprises an arm, rotatable about the wrapping axis and provided with a supporting portion parallel to the wrapping axis and adapted for slidably supporting said unwinding apparatus, and a second driving system for linearly moving said unwinding apparatus along said supporting portion of said arm.

19. The wrapping machine according to claim 17, wherein said moving system comprises a ring rotatable about the wrapping axis and supporting said unwinding apparatus.

20. The wrapping machine according to claim 17, further comprising a rotary table arranged to support and rotate the load about the wrapping axis, said moving system comprising a column slidably supporting said unwinding apparatus and a second driving system arranged to move said unwinding apparatus linearly along said column.

* * * * *